US005439148A

United States Patent [19]

Driessen

[11] Patent Number: 5,439,148

[45] Date of Patent: Aug. 8, 1995

[54] DISPENSING SYSTEM FROM A CONTAINER UNDER PRESSURE

[75] Inventor: Johannes W. J. Driessen, Leidschendam, Netherlands

[73] Assignee: B.J. Driessen & Zn. B.V., The Hague, Netherlands

[21] Appl. No.: 98,323

[22] PCT Filed: Feb. 5, 1992

[86] PCT No.: PCT/NL92/00026

§ 371 Date: Oct. 14, 1993

§ 102(e) Date: Oct. 14, 1993

[87] PCT Pub. No.: WO92/13780

PCT Pub. Date: Aug. 20, 1992

[30] Foreign Application Priority Data

Feb. 6, 1991 [NL] Netherlands ..... 9100208

[51] Int. Cl.[6] ..... B65D 83/00

[52] U.S. Cl. ..... 222/402.1; 222/402.11

[58] Field of Search ..... 222/147, 321, 402.1, 222/402.11, 383, 385, 570, 464, 541, 402.14, 402.24; 285/1-4, 319, 921

[56] References Cited

U.S. PATENT DOCUMENTS

| | | | |
|---|---|---|---|
| 3,187,963 | 6/1965 | Anderson | 222/402.14 |
| 3,580,431 | 5/1971 | Kuffer et al. | 222/402.1 |
| 3,942,725 | 3/1976 | Green | 239/468 |
| 5,277,340 | 1/1994 | Van Brocklin | 285/921 |
| 5,285,776 | 2/1994 | Betram | 285/319 |

FOREIGN PATENT DOCUMENTS

| | | | |
|---|---|---|---|
| 2016300 | 5/1970 | France . | |
| 2440909 | 4/1975 | Germany . | |
| 768734 | 2/1957 | United Kingdom . | |
| 2198189 | 6/1988 | United Kingdom | 222/402.1 |

*Primary Examiner*—Andres Kashnikow
*Assistant Examiner*—Philippe Derakshani
*Attorney, Agent, or Firm*—Young & Thompson

[57] ABSTRACT

In an aerosol provided with a container for a medium under pressure, and with a spray nozzle which is connected to a medium supply device of the container, and with which the medium can be sprayed after the opening of a valve provided between container and supply device, the spray nozzle and the supply device are provided with fixing devices for irreversibly fixing the spray nozzle on the supply device. For this purpose, the supply device and the spray nozzle can bear barbed fixing devices, in such a way that the spray nozzle can be fitted on the supply device by sliding towards it, but is blocked in the oppposite direction. The parts of the spray nozzle and/or of the supply device determining the flow connection can have a weakened part, which weakened part is broken when the spray nozzle is removed from the supply device, in such a way that the flow connection is damaged.

10 Claims, 2 Drawing Sheets

DISPENSING SYSTEM FROM A CONTAINER UNDER PRESSURE

FIELD OF THE INVENTION

The invention relates to an aerosol provided with a container for a medium which is under pressure, and also a spray nozzle which is connected to a medium supply device of the container, and with which the medium can be sprayed after the opening of a valve provided between container and supply device.

BACKGROUND OF THE INVENTION

Such aerosols are generally known. They can contain all kinds of liquid media. In particular, however, the invention relates to aerosols which are suitable for paints, lacquers and surface coating products such as undercoating, Bittac, ML etc.

The problem occurring with paint aerosols is that they are widely used for producing graffiti. Since the current types of paint which are applied with paint aerosols are weatherproof and wind-resistant, graffiti cause great damage and nuisance. Daubed walls, traffic signs, advertisement boards, window panes, panels, shopfronts, letterboxes, defaced bus stops and street maps, and housefronts and trains covered in graffiti are a great nuisance. Moreover, graffiti are often accompanied by dirt and dilapidation.

No good solution has been found so far to the graffiti problem. Although paint aerosols are quite expensive, they are still used on a large scale by young people in particular for producing drawings, names and the like. All this is helped along by the fact that in many large chain stores the paint aerosols are, as it were, there for the taking. It has in fact been found from recent research that a substantial percentage of the paint aerosols used for producing graffiti are stolen. In practice, little or nothing can be done to prevent the theft of paint aerosols. However, if the group of young people responsible for producing graffiti had difficulty in obtaining paint aerosols, we would already be part of the way towards solving the problem.

SUMMARY OF THE INVENTION

The object of the invention is therefore to make theft of such aerosols less attractive. According to the invention, this is achieved by providing a dispensing system for a medium which is under pressure, consisting of a separately provided spray-nozzle as well as of a container which contains said medium, which spray-nozzle is adapted to be fixed irreversibly to the medium supply device of said container, and whereby the parts of the spray-nozzle and/or of the supply device determining the flow connection have (a) weakened portion(s) which is (are) rupturable upon an attempt to remove said spray-nozzle from the container.

The containers can now be offered for sale without spray nozzle. The spray nozzles are kept separate from the containers, for example at a checkout, until the moment of purchase. Once the sale has been concluded, the purchaser is also given the appropriate spray nozzle. Only then does the purchaser have an aerosol which is actually usable. Anyone taking an aerosol and not paying for it at the checkout, and thus obtaining it without a spray nozzle, can do little with the container.

Since the spray nozzle can also be fixed irreversibly to the supply device, it is not possible to remove the spray nozzle from one container and fit it on another.

Taking the aerosol according to the invention without paying for it is now considerably less attractive, since there is no spray nozzle on it. The theft of aerosols can be prevented more effectively in this way.

As soon as any attempt is now made to remove the spray nozzle from the container, the flow connection becomes damaged. This means that, after opening of the valve, the contents of the container, such as paint, are no longer guided correctly through the spray nozzle, but can escape through the damaged place. In that case the aerosol can no longer be used properly, since the paint can gush out from under the nozzle.

According to a first possibility, the fixing means can contain a weakened part. In that case these fixing means are damaged when an attempt is made to remove the spray nozzle from the container.

The supply device can be a supply tube with a number of notches, while the spray nozzle can have a spring-loaded barbed element, in such a way that the barbed element can be slid onto the notches, but is blocked in the opposite direction. As soon as an attempt is made to force the spray nozzle, the barbed element or the notches are damaged.

According to a second possibility, the spray nozzle can have an apron which is insertable on the supply tube and which connects by way of a part with reduced wall thickness to the inside of the top face of the spray nozzle. At the position of this part with reduced wall thickness the apron can tear off from the spray nozzle if an attempt is made to remove it from the container. This produces an opening in the flow connection of the container to the spray nozzle, with the result that the paint can escape along the spray nozzle.

As an alternative, provision can be made for the supply tube to have a part with reduced wall thickness between the notches and the container. In this embodiment the supply tube tears when an attempt is made to remove the spray nozzle, so that here again the paint can escape along the spray nozzle.

The invention also relates to a container for an aerosol of the type described above, and to a spray nozzle for an aerosol of the type described above.

BRIEF DESCRIPTION OF THE DRAWINGS

The invention will be explained in greater detail below with reference to two examples of embodiments.

DETAILED DESCRIPTION OF THE INVENTION

Figure 1:
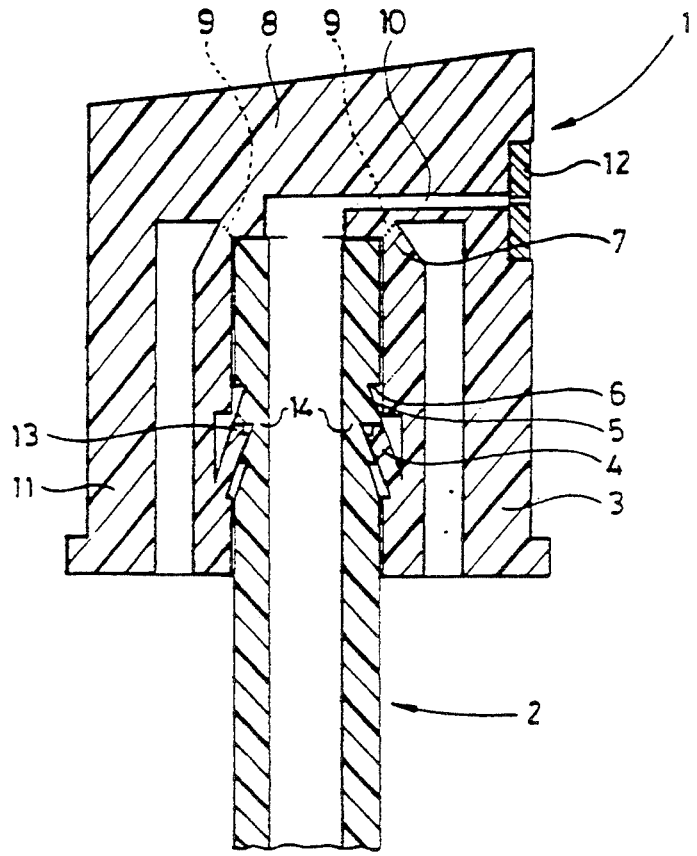
FIG. 1 shows a first embodiment of a detail of the aerosol with discharge tube and spray nozzle.

The spray nozzle 1 shown in FIG. 1 is pushed onto a supply tube 2, projecting from a container which is not shown in any further detail. The spray nozzle 1 can be fixed to the supply tube 2 by simply sliding it with its apron 3 over the tube (male valve). An inward-directed, spring-loaded, barbed ring 4 is provided inside the apron 3 and can interact with grooves 5 on the outside of the supply tube 2. The grooves 5 have stop faces 6, against which the barbed ring 4 comes to rest. As soon as the spray nozzle 1 is fully pushed onto the discharge tube 2, the barbed ring 4 is locked relative to the notches 5.

A person buying an aerosol can thus fit the spray nozzle 1 on the supply tube 2 very simply himself.

The apron 3 of the spray nozzle 1 is connected by means of a part with reduced diameter 7 to the top face 8 of the spray nozzle. Nominal fracture surfaces 9 ape shown by broken lines in this part with reduced cross-section 7. As soon as an attempt is made to remove the spray nozzle 1 from the supply tube 2, the apron tears off at that point of the top face 8. If the nozzle is placed on the supply tube 2 again after that, a properly sealed connection between discharge tube 2 and the channel 10 into the spray nozzle can no longer be obtained, with the result that the paint coming out of the supply tube 2 can run out round the outer annular part 11 of the spray nozzle 1.

The atomizer part of the spray nozzle 1 is indicated by 12.

The notch 13 can be made deeper than the other notches. A nominal fracture point 14 can thus also be obtained at the position of this notch 13. It must be remembered that the nominal fracture points 9 and 14 can be used either together or separately.

Figure 2:
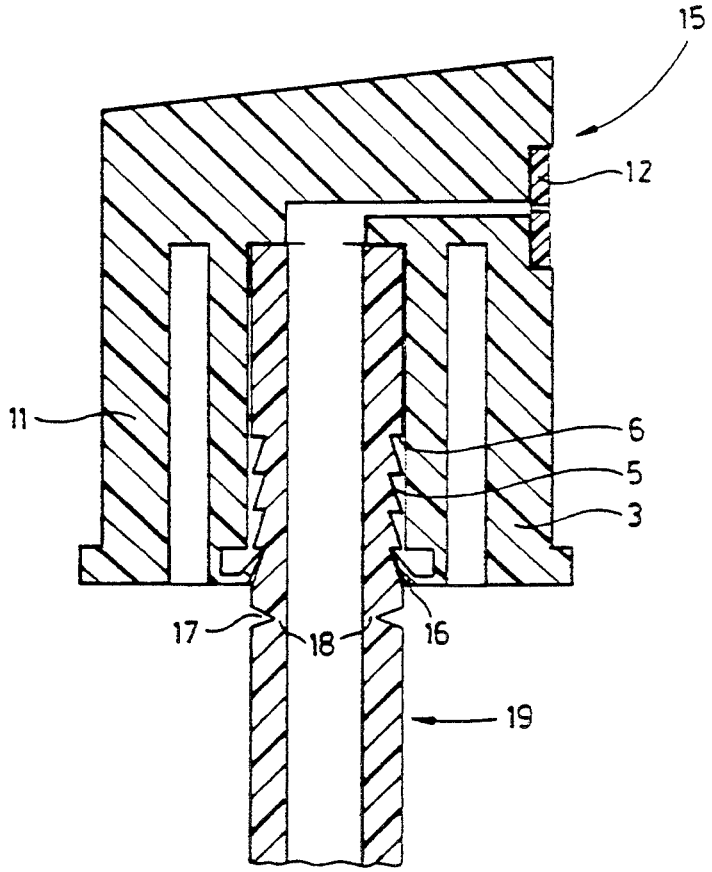
FIG. 2 shows a variant of FIG. 1.

FIG. 2 shows a variant of the spray nozzle 15 according to the invention. Here again, a number of notches 5 with stop face 6 are provided on the outside of the supply tube 19. The apron 3 of the spray nozzle 15 is also provided on its underside with a barbed edge 16, with which it can engage in the notches 5. The supply tube 2 can also be provided with an area with reduced cross-section 17, which forms a nominal fracture point 18.

If in the case of this embodiment an attempt is made to remove the spray nozzle 15 from the supply tube 19, it will tear at the position of the nominal fracture point 18. Here again, the flow connection between the container 19 and the spray nozzle 15 will be lost, in such a way that the paint can also escape round the outer annular part 11 of the spray nozzle 15.

Figure 3:
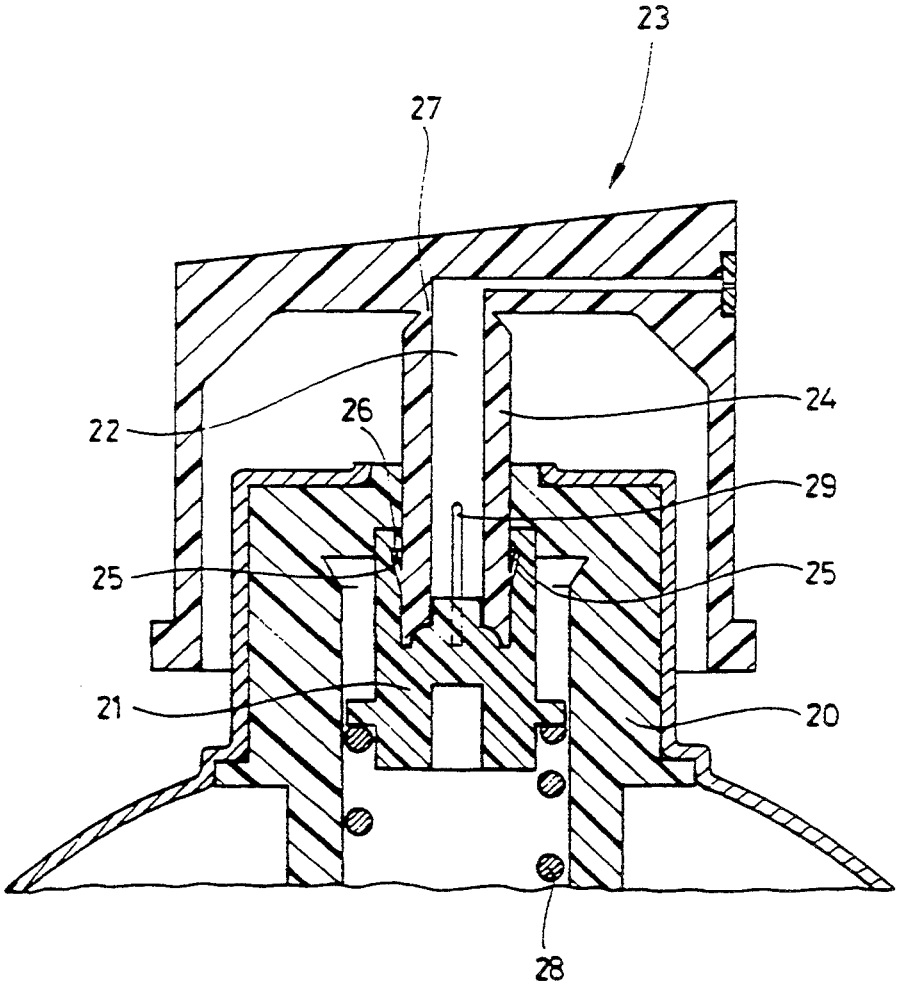
FIG. 3 shows a second embodiment.

The second embodiment shown in FIG. 3 concerns a container with a so-called "female valve". The collar 20 forms part of the container, which is not shown in any further detail. Said collar 20 contains a female valve 21, which is held pressed in a sealing manner against collar 20 by spring 28. The recess 22 is in communication with the container via slit 29.

Valve 21 is provided with a recess 22 into which the supply tube 24 provided on the spray nozzle 23 can be inserted. This supply tube 24 has barbed projections 25, with which it can be blocked in a corresponding notch 26 of the valve 21. A weakened part 27 is also provided.

I claim:

1. A dispensing system for a medium which is under pressure, comprising a separately provided spray nozzle for a container which contains said medium, said spray nozzle being adapted to be fixed irreversibly to a supply device of said container, wherein parts of the spray nozzle and the supply device, which together establish fluid communication, have at least one weakened portion to facilitate rupturing upon an attempt to remove said spray nozzle from the container.

2. A dispensing system according to claim 1, wherein the supply device and the spray nozzle bear barbed fixing means, such that the spray nozzle can be fitted on the supply device by sliding towards it, but is blocked in an opposite direction.

3. A dispensing system according to claim 1, wherein the parts of at least one of the spray nozzle and the supply device have a weakened part which is broken when the spray nozzle is removed from the supply device, whereby said fluid comunication is damaged.

4. A dispensing system according to claim 2, wherein the fixing means comprise a weakened part.

5. A dispensing system according to claim 1, wherein the supply device includes a supply tube with a number of notches, and the spray nozzle has a spring-loaded barbed element.

6. A dispensing system according to claim 1, wherein the supply device has a supply tube with a barbed element, and the spray nozzle has one or more notches.

7. A dispensing system according to claim 1, wherein the supply device includes a supply tube, and the spray nozzle has an apron adapted to be pushed onto the supply tube, said apron connecting to the inside of a top face of the spray nozzle by a part having a reduced wall thickness.

8. A dispensing system according to claim 5, wherein the supply tube has a part having a reduced wall thickness between the notches and the container.

9. A dispensing system according to claim 1, wherein the supply device has a hollow valve seat with a number of internal notches, and the spray nozzle includes a tube having an external spring-loaded barbed element adapted to be received in one of said notches.

10. A dispensing system according to claim 1, wherein the spray nozzle includes a tube having a number of internal notches, and the supply device has a hollow valve seat with a centrally disposed spring-loaded barbed element adapted to be received in one of said notches.

* * * * *